US005471032A

United States Patent [19]

Spellman et al.

[11] Patent Number: 5,471,032

[45] Date of Patent: Nov. 28, 1995

[54] ELECTRICAL RESISTANCE IGNITOR WITH SPACED PARALLEL FILAMENTS BRAZED IN REFRACTORY BLOCK RECESSES

[75] Inventors: Gordon B. Spellman, Mequon; C. Greg Chen, River Hills, both of Wis.

[73] Assignee: Eaton Corporation, Cleveland, Ohio

[21] Appl. No.: 129,510

[22] Filed: Sep. 30, 1993

[51] Int. Cl.[6] ..... F23Q 7/22

[52] U.S. Cl. ..... 219/270; 219/267; 219/537; 219/541; 338/312; 338/319; 338/329; 338/306; 29/611; 29/621

[58] Field of Search ..... 219/260–270, 219/521, 537, 539, 542, 532, 541, 552; 338/311, 312, 319, 320, 329, 306, 315, 283–285, 290, 291, 293; 392/433, 434, 435; 29/611, 621

[56] References Cited

U.S. PATENT DOCUMENTS

| | | | |
|---|---|---|---|
| 1,565,539 | 12/1925 | Woodson | 392/434 |
| 2,735,881 | 2/1956 | Mann | 219/541 |
| 3,121,154 | 2/1964 | Menzies et al. | 219/541 |
| 3,525,850 | 8/1970 | Hager, Jr. | 392/433 |
| 3,852,175 | 12/1974 | Hoekje | 204/293 |
| 4,036,727 | 7/1977 | Rahn | 204/291 |
| 4,107,510 | 8/1978 | Tombs et al. | 219/270 |
| 4,205,363 | 5/1980 | Boos et al. | 219/270 |
| 4,206,492 | 6/1980 | Rhodes et al. | 219/270 |
| 4,228,344 | 10/1980 | Boos et al. | 219/270 |
| 4,749,845 | 6/1988 | Rasmussen et al. | 219/541 |

FOREIGN PATENT DOCUMENTS

| | | | |
|---|---|---|---|
| 45001 | 3/1928 | Norway | 392/434 |
| 574107 | 12/1945 | United Kingdom | 392/435 |
| 798206 | 7/1958 | United Kingdom | 392/435 |
| 2086565 | 5/1982 | United Kingdom | 392/433 |

*Primary Examiner*—John A. Jeffery
*Attorney, Agent, or Firm*—Roger A. Johnston

[57] ABSTRACT

An ignitor for fuel gas burners formed of a plurality of spaced parallel filaments of SiC coated Carbon (C) high temperature brazed with Chromium Silicide in grooves provided in a refractory base block of Aluminum Oxide and Silicon Oxide. Terminal posts of IVIoSi are embedded in the high temperature braze. Stainless steel lead attachment pads are nickel-chrome brazed to the posts at a lower temperature. Removable notched graphite bridges and graphite hold-down blocks position the filaments during the high temperature brazing.

3 Claims, 1 Drawing Sheet

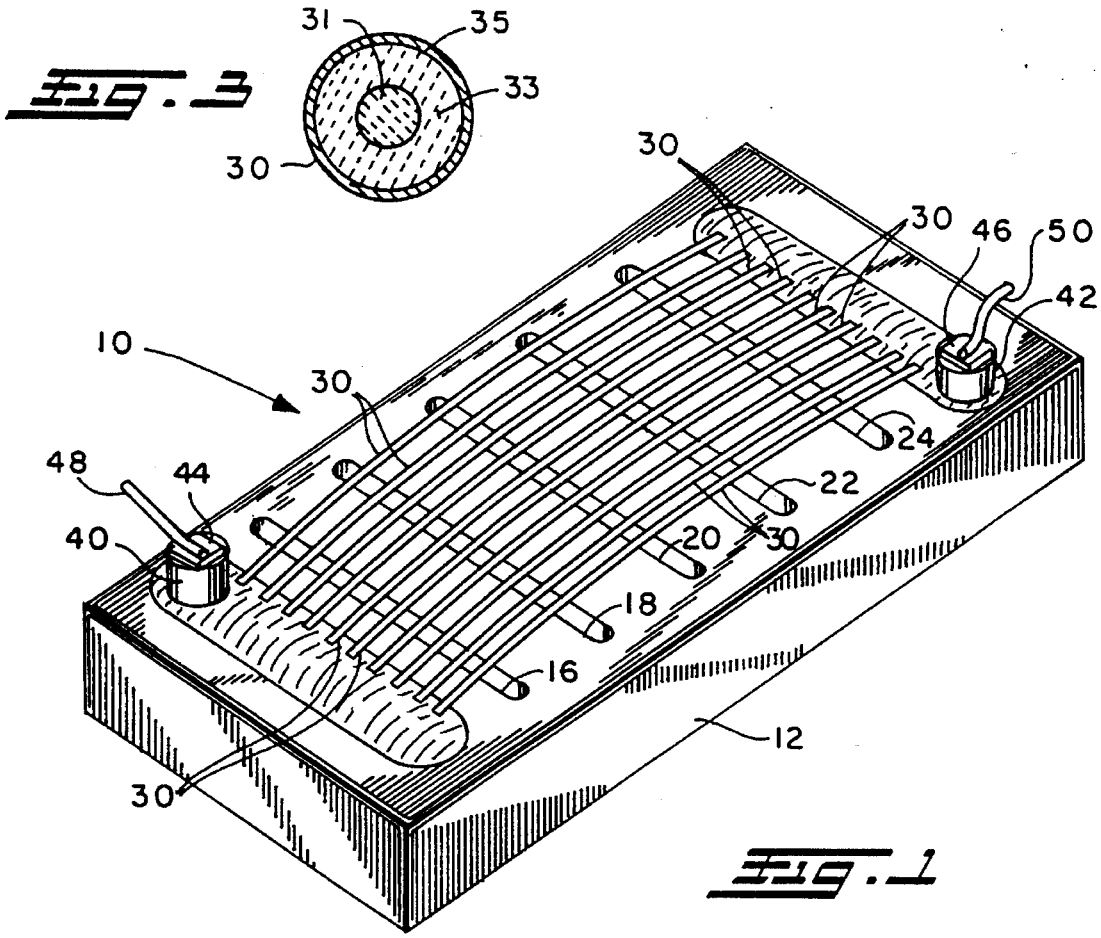
FIG. 3
FIG. 1
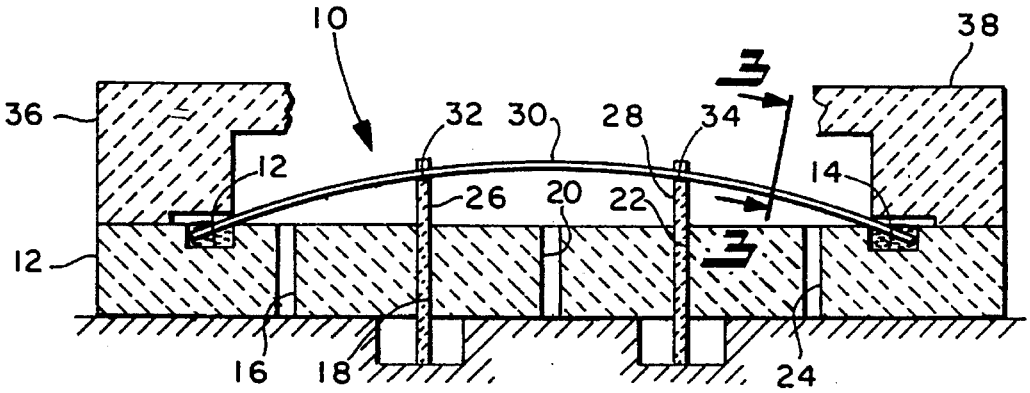
FIG. 2

ELECTRICAL RESISTANCE IGNITOR WITH SPACED PARALLEL FILAMENTS BRAZED IN REFRACTORY BLOCK RECESSES

BACKGROUND OF THE INVENTION

The present invention relates to devices for electrically igniting fuel gas emanating from a burner of the type employed for appliances such as cooking ranges, ovens, clothes driers, water heaters, and other appliances. Electrical resistance ignitors are typically employed in burner ignition systems in either parallel or series connection with an electrically operated fuel gas valve for controlling flow of fuel to the burner. In parallel systems, current is supplied simultaneously to the fuel valve and the ignitor and a flame sensor is operative to effect closing of the fuel valve, if ignition does not occur within a predetermined time. In series systems, the ignitor is electrically series-connected with an electro-thermal actuator in the valve. The ignitor in such a system typically possesses a negative slope to the resistance versus temperature relationship; and, the current flow through the ignitor is not sufficient to effect opening of the electrical fuel valve until the ignitor has reached an ignition temperature wherein the resistance of the ignitor has dropped to a level sufficient to permit flow of sufficient current to effect valve opening.

In the aforesaid series type electrical ignition systems for fuel gas burners, it is required to carefully control the resistance properties of the ignitor and valve thermal actuator in order to prevent inadvertent opening of the valve when variations in power line voltage are experienced. Typically, electrically operated fuel gas valves employ a resistance heating device to heat a bimetal operator which effects opening of the valve poppet. Variations in the resistance properties of the valve heater element, in combination with tolerances on the resistance properties of the ignitor require careful control and manufacturing processes of both the ignitor and the gas valve to prevent opening of the gas valve under conditions which could cause discharge of fuel gas without ignition.

In the manufacture of electrical resistance ignitors for fuel gas burners, it has been found difficult to control the electrical resistance properties of the ignitor during fabrication, inasmuch as the materials employed for the ignitor are generally refractory materials, such as Silicon Carbide (SIC). The electrical properties of such materials are typically controlled during manufacturing by the addition of minor amounts of dopants or impurities, and, the control of these additions has proven very difficult in mass production.

Accordingly, it has been desired to provide an electrical resistance ignitor which may be employed for igniting fuel gas emanating from a burner, and which exhibits accurately an easily controllable electrical property, properties enabling the ignitor to be mass produced in high volume for application to domestic appliances.

SUMMARY OF THE INVENTION

The present invention employs relatively small diameter filaments of elemental carbon material coated with Silicon Carbide which may be optionally overcoated with carbon arranged in an array of spaced filaments which have their ends embedded in high temperature brazing material and attached to a base of refractory material. A metallic Silicide terminal means is also partially embedded in the braze and serves to provide a post for secondary lower temperature brazing of a metal pad thereon for facilitating welded attachment of electrical leads to the filaments. The high temperature braze preferably comprises a mixture of Silicon and Chromium Silicide ($CrSi_2$) and is provided in recesses formed in a common surface of the base adjacent the ends thereof. The terminal means preferably comprises Molybdenum Silicide ($MoSi_2$). The lower temperature braze preferably comprises a Nickel Chrome suppressed melting point braze securing a high-Chromium alloy stainless steel pad to the terminal means. The refractory base preferably comprises a mixture of equal parts of aluminum oxide and silicon oxide.

The ignitor assembly is formed by bowing the filaments over bridges of refractory material received through slots in the base.

BRIEF DESCRIPTION OF THE DRAWINGS

FIG. 1 is an axonometric view of the ignitor assembly of the present invention; and, FIG. 2 is a longitudinal sectional view of the ignitor in process prior to the high temperature brazing.

FIG. 3 is a cross-section taken along section indicating lines 3—3 of FIG. 2.

DETAILED DESCRIPTION

Referring to FIGS. 1 and 2, the ignitor assembly is indicated generally at 10, and has a base structure or block 12 formed of suitable ceramic material which, in the presently preferred practice, comprises a mixture of equal parts of aluminum oxide and Silicon Oxide, each in the amount of about 48%, with the balance impurities. The block 12 has a pair of grooves formed therein in spaced-parallel arrangement with each groove generally disposed adjacent one end of the block, as denoted by reference numerals 14, 16 in FIG. 2. Block 12 also has a plurality of slots disposed in generally parallel relationship with grooves 12, 14, and equally spaced therebetween as denoted by reference numerals 16, 18,20, 22,24.

Referring to FIG. 2, a pair of grooved bridges denoted by reference numerals 26,28, each formed of refractory material, preferably graphite, are inserted through grooves 18,22. A plurality of filaments 30 are placed in the spaced grooves, two of which are illustrated and denoted by numerals 32,34 formed in the bridges 26,28. One of the filaments 30 is illustrated in cross-section in FIG. 3 and is formed of elemental carbon 31 coated with silicon carbide 33 which may be optionally overcoated with carbon 35. The ends of the filaments 30 are retained in the grooves 12,14 by suitable refractory preferably graphite clamping blocks 36,38, which will be understood are discarded after further processing.

Weldment material in the form of a high temperature brazing compound comprising a vacuum mix or pressed pre-form of metallic Silicide, preferably a mixture of Chromium Silicide ($CrSi_2$) with excess Silicon in an organic binder with water is placed in the grooves 12, 14 in preparation for firing. In the present practice an organic binder of gum and water has been satisfactorily employed; and, one particular binder obtainable from Wall Colmony, 30261 Stephens Highway, Madison Heights, Mich. 48071, bearing manufacturer's designation Cement-S has been found suitable. In the presently preferred practice, the weldment or high temperature brazing material is a mixture of one part by weight Chromium Silicide ($CrSi_2$) to 1.8 parts elemental Silicon. The weldment may be enhanced by the addition of minor amounts of metallic materials selected from the group consisting of metallic silicides, metallic oxides, metallic nitrides, and metallic carbides.

Referring to FIG. 1, terminal means in the form of posts 40,42 are prepositioned in the weldment or brazing mixture prior to firing to provide stanchions for electrical attachment thereto. In the presently preferred practice, the posts 40,42 or terminal means are formed of sintered material comprising about 90% Molybdenum DiSilicide ($MoSi_2$); however, other refractory materials may be employed as, for example, reaction bonded Silicon Carbide.

In the presently preferred practice, the weldment or high temperature brazing material is formed of a 35/65 mixture by weight of Chromium Silicide and Silicon powder (i.e., 1 $grC_r$ $Si_2$ to 1.8 gr Si); and, the surface of the grooves is coated with Silicon Carbide granules in an Oxyphosphate binder. The ignitor in the configuration illustrated in FIG. 2 is then heated in a vacuum furnace or reducing atmosphere to a temperature of at least 1300° C. and preferably in the range of 1360°–1410° C. for about ten minutes to cause the weldment or high temperature brazing material to flow and wet the surface of each of the filaments 30 and the base region of each of the terminal means or posts 40,42.

After the firing, the assembly is removed from the oven, and the bridges 26,28 are removed; and, the clamping blocks 36,38 are removed. The assembly thus far is then ready for the second stage or lower temperature brazing operation, as will hereinafter be described. Referring to FIG. 1, the terminal means 40,42 each have the top surface thereof coated with a pre-form of preferably nickel-chrome brazing material and a pad or connector plate 44,46 is disposed thereon. The assembly is then heated or re-fired to a temperature in the range 1050–1250 degrees Centigrade in the hydrogen or cracked ammonia ($NH_3$) atmosphere to braze the pads 44,46 onto the terminal posts 40,42. In the presently preferred practice, the pads 44,46 are formed of stainless steel in the 400 Series having a nominal composition of 26% Chromium, 1% nickel, balance iron. In the presently preferred practice, stainless steel provided by Allegheny Ludlum, bearing manufacturer's designation 26-1 Ebrite has been found particularly satisfactory.

After removal from the brazing oven and cooling, each of the pads 44,46 has an electrical lead 48,50 welded thereto.

It will be understood that the desired resistance of the ignitor may be obtained by determining the electrical resistance of the filament material 30 per unit length and providing the length and number of filaments necessary to give the desired overall resistance and current-carrying capability. In the present practice of the invention, the filaments have a length on the order of three inches.

Alternatively, the terminal means 40,42 may be formed of chrome carbide or Tungsten Silicide. The terminal means 40,42 preferably has a coefficient of thermal expansion less than 10 ppm/C and a melting point greater than 1300° C.

It will be understood that the locating blocks 36,38 may be interconnected; and, suitable locating devices such as, for example, locator pins (not shown) may be employed or recesses or guides for registering on the edges of the block 12 to locate the surfaces of the guide blocks for pressing on the filaments as desired may be provided.

Although the invention has been described hereinabove with respect to the illustrated embodiments, it will be understood that the invention is capable of variation and modification from the illustrated embodiments; and, the invention is intended as limited only by the following claims.

We claim:

1. The method of making an electrical resistance ignitor for gaseous fuel comprising:

(a) forming a pair of spaced recesses in a refractory base;

(b) disposing an array of relatively thin filaments coated with silicon carbide material with opposite ends thereof in said recesses;

(c) disposing a mixture of elemental silicon and chromium silicide ($CrSi_2$) in said recesses; and, (d) heating said base, filaments, and mixture to a temperature of at least 1300° C. and melting said mixture and securing the ends of said filaments by weldment in said recesses; and, (e) providing terminal means and securing same in said weldment and brazing a connector to said .terminal means at a temperature substantially less than said 1300° C.

2. The method defined in claim 1, further comprising providing terminal means and securing same in said weldment.

3. The method defined in claim 1, further comprising adding to said mixture minor amounts of material selected from the group consisting of metallic silicides, metallic oxides, metallic nitrides, and metallic carbides.

* * * * *